US005097180A

United States Patent [19]

Ignon et al.

[11] Patent Number: 5,097,180

[45] Date of Patent: Mar. 17, 1992

[54] FLICKERING CANDLE LAMP

[76] Inventors: Roger Ignon, 3429 La Selva Pl., Palos Verdes Estates, Calif. 90274; Fred Schmidt, 312 S. Broadway, #4, Redondo Beach, Calif. 90277

[21] Appl. No.: 583,962

[22] Filed: Sep. 14, 1990

[51] Int. Cl.[5] ..... H05B 41/36

[52] U.S. Cl. ..... 315/200 A; 315/208; 315/307; 315/209 R; 315/226; 362/161; 362/810

[58] Field of Search ..... 315/200 A, 208, 307, 315/209 R, 219, 226; 362/161, 810, 190, 197

[56] References Cited

U.S. PATENT DOCUMENTS 3,710,182 1/1973 Van Reenen ..... 315/200 A X
4,510,556 4/1985 Johnson ..... 362/810 X
4,593,232 6/1986 McEdwards ..... 315/199

*Primary Examiner*—Eugene R. LaRoche

*Assistant Examiner*—Ali Neyzari

[57] ABSTRACT

A self contained battery operated table lamp for use in restaurants, and the like. The lamp includes an electric light which is energized on an intermittent basis by a switching circuit to assure long battery life. A feed back loop is included in the switching circuit for establishing the duty cycle of the energizing power intermittingly applied to the lamp. A flicker signal generator is connected to the energizing circuit of the light to introduce a flicker into the output of the light. The flicker signal generator incorporates a plurality of independent oscillators, each operating at a slightly different frequency. The outputs of the various oscillators are summed in a summing network with each being given a slightly different weighting factor, and the resulting signal is injected into a feedback loop to modify the average voltage of the light. The lamp is caused to provide a pseudo-random candle simulating effect.

13 Claims, 3 Drawing Sheets

FLICKERING CANDLE LAMP

BACKGROUND OF THE INVENTION

A self-contained battery operated electric lamp is provided for use as a table lamp in restaurants, and which is intended to replace existing candle holders. The lamp provides a flickering light which simulates a candle.

SUMMARY OF THE INVENTION

A self-contained battery operated table lamp unit for use in restaurants. The lamp is energized on an intermittent basis to assure long battery life. A plurality of electronic signal generators are incorporated into the unit to provide a pseudotype random candle simulating flicker effect for the lamp.

DETAILED DESCRIPTION OF THE ILLUSTRATED EMBODIMENT

Figure 1:
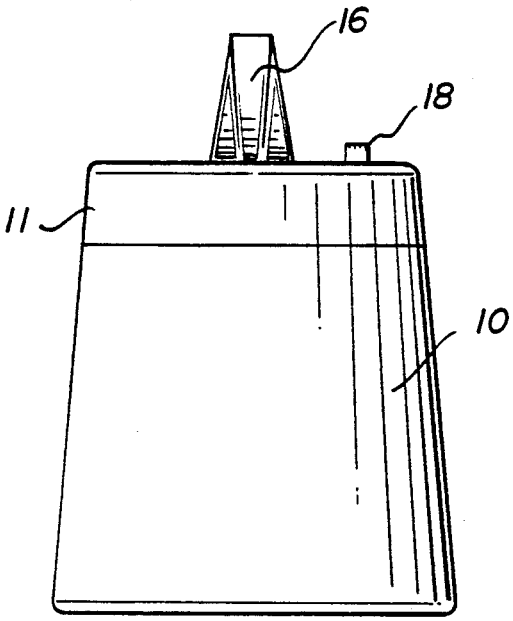
FIG. 1 is a side elevational view of one embodiment of the lamp of the invention.
Figure 4:
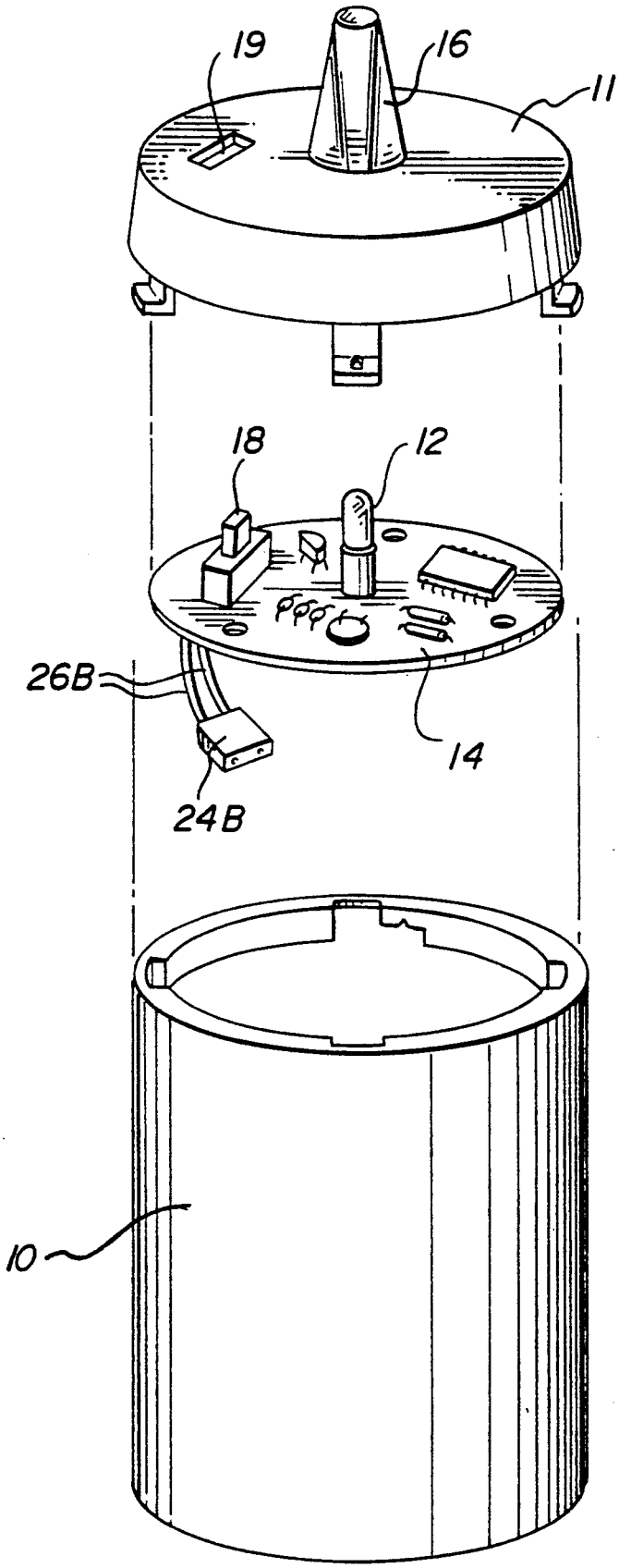
FIG. 4 is a detached perspective representation of the lamp of FIG. 1.

The lamp shown in FIGS. 1 and 4 includes a housing 10 which may be formed of plastic, or any other appropriate material, and a cap 11 removably mounted on the open top of the housing. A light bulb 12 is supported on a printed circuit board 14 mounted within the housing 10 and the light bulb projects upwardly through the top of the housing to be enclosed by a lens 16. Lens 16, for example, may be composed of clear plastic. An on-off switch 18 is also supported on the circuit board 14 and protrudes outwardly through the opening 19 in the top of the housing.

Figure 2:
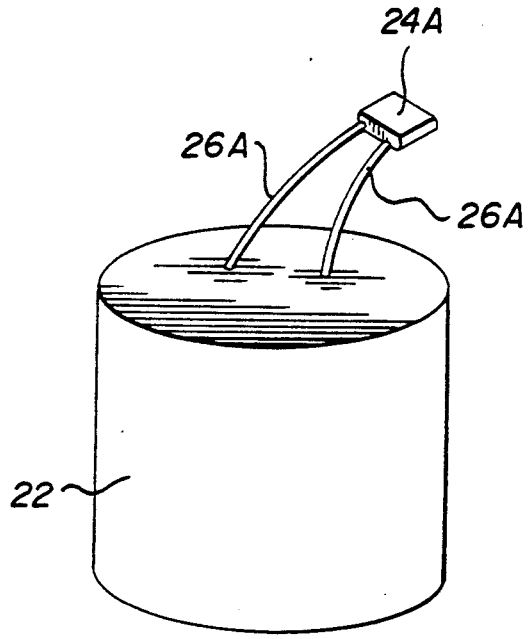
FIG. 2 is a perspective view of a battery pack which is removably contained in the lamp of FIG. 1.

A replaceable battery pack 22 (FIG. 2) is contained within housing 10, and is connected to the electronics mounted on the underside of circuit board 14 by means of appropriate connectors 24A, 24B. The battery pack may, for example, be "C" cell batteries connected by leads 26A to connector 24A, as shown in FIG. 2. Connector 24B is connected to the printed circuit on the underside of circuit board 14 by leads 26B, as shown in FIG. 4.

In the embodiment of FIG. 4, the printed circuit board 14 fits into the top of the housing 10. The board is held in place by removable cap 11, and the bulb 12 protrudes through the cap and into the transparent lens 16. The cap 12 is mounted on and removed from housing 10, for example, by a ¼ turn lock.

Figure 3:
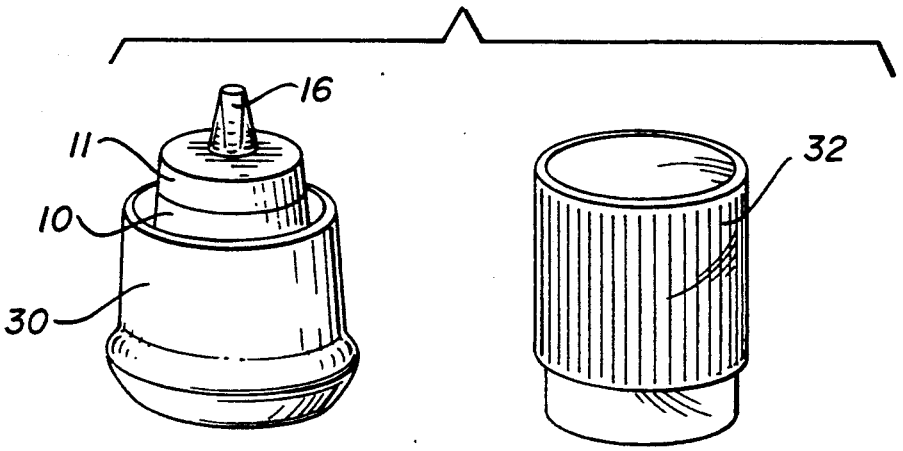
FIG. 3 is a perspective view of an appropriate holder for the lamp.

The lamp may be inserted into an appropriate holder 30, as shown in FIG. 3, which is free standing; and a transparent globe 32 may be inserted into the holder to surround the lamp.

Figure 5:
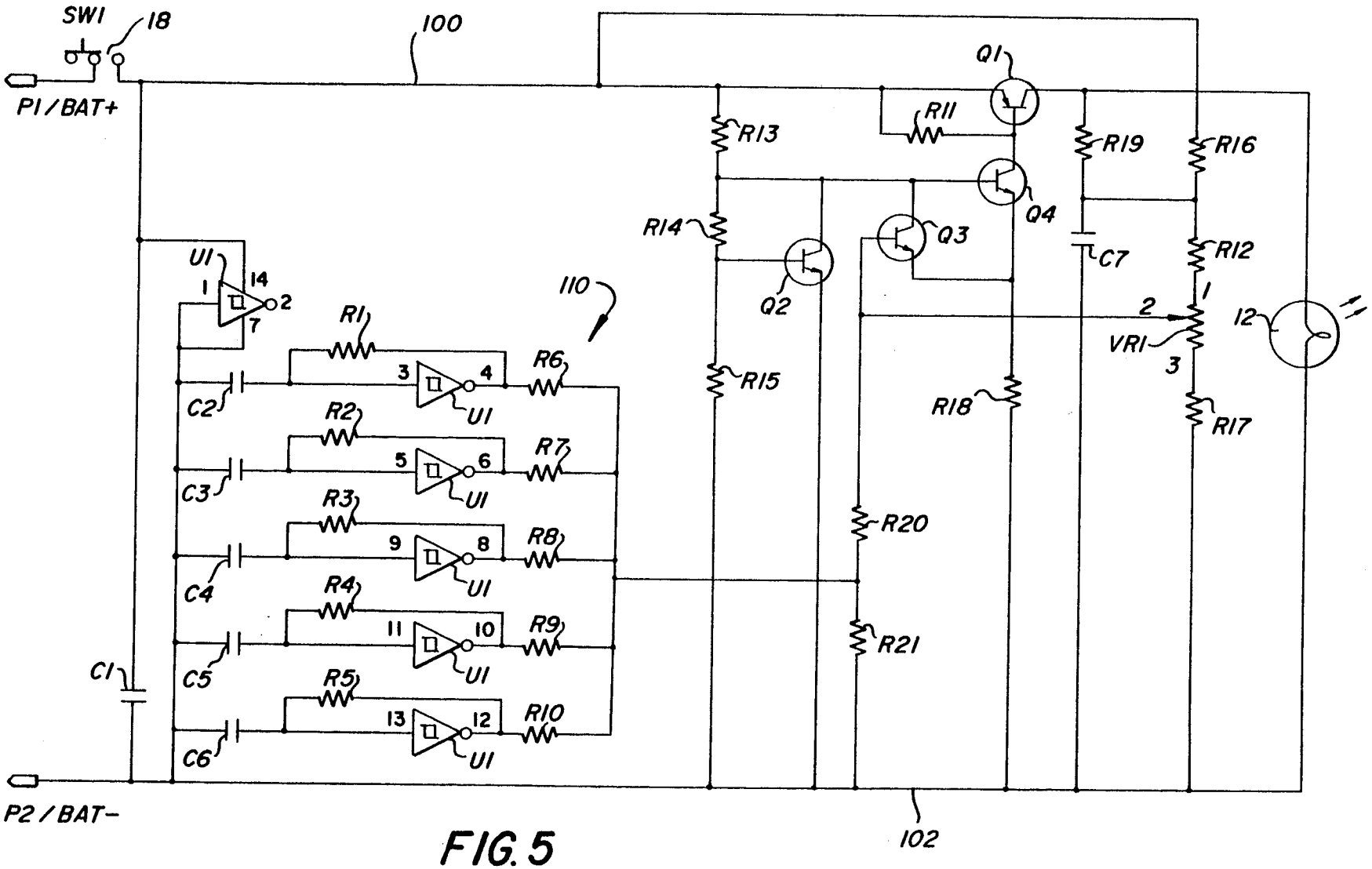
FIG. 5 is circuit diagram of the electronics contained in the lamp unit, in one embodiment.

In the circuit diagram of FIG. 5, terminals P1 and P2 of the circuit are connected to the battery connector 24B of FIG. 4. Terminal P2 is connected to a positive power lead 100 through the switch 18 of FIG. 1, which is a single pole double throw switch designated SW1 in FIG. 5. Lead P2 is connected to the negative power terminal 102. Power lead 100 is connected to the emitter of a PNP switching transistor Q1 which may be of the type designated 2N4403. The collector of the transistor is connected to the lamp 12, which is also connected to the negative power lead 102. The power lead 100 is also connected to a 20 kilo ohms resistor R16 which, in turn, is connected through a 75 kilo ohm resistor R12 and a 100 kilo ohm trimmer potentiometer VR1 to a 75 kilo ohm resistor R17. Resistor R17 is connected to the negative power lead 102.

The collector of transistor of Q1 is also connected through a 3 kilo ohm resistor R19 to a 2.2 microfarad capacitor C7, which, in turn, is connected to the negative power lead 102.

A 5.1 kilo ohm resistor R11 is connected between the emitter and base of transistor Q1. A 39 kilo ohm resistor R13 is connected to a 13 kilo ohm resistor R14 which, in turn, is connected to a 36 kilo ohm resistor R15 connected to the negative power lead 102. The junction of resistors R14 and R15 is connected to the base of an NPN transistor Q2 which may be of the type designated 2N5088. The emitter of transistor of Q2 is connected to the negative power lead 102. The collector of transistor Q2, together with the collector of an NPN transistor Q3, is connected to the base of an NPN transistor Q4. Transistors Q3 and Q4 may each be of the type designated 2N5088. The collector of transistor Q4 is connected to the base of transistor Q1, and the emitter of transistor Q4 is connected to a 100 ohm resistor R18 which is connected to the negative lead 102.

The base of transistor Q3 is connected to a 360 kilo ohm resistor R20 which, in turn, is connected to a 510 kilo ohm resistor R21. Resistor 21 is connected to the negative power lead 102. The base of transistor Q3 is also connected to the moveable contact of potentiometer of VR1.

The lamp 12 of FIGS. 1 and 4 is intended for use with replacement C cell battery pack 22, shown in FIG. 2. The normal battery life of the lamp is about 350 hours. The lamp may also be designed for use with a D cell battery pack, with approximately 450 hours of battery life. The latter embodiment may incorporate the battery unit as an integral part of the whole unit, rather than a replacement cartridge.

As mentioned above, the transistor Q1 is a switching transistor. When the transistor Q1 is conductive, the lamp 12 is connected across the battery leads 100 and 102. Conversely, when the transistor Q1 is non-conductive, the lamp 12 is disconnected from the battery. Transistor Q1 is switched on and off approximately 300 times a second. The actual rate at which the transistor Q1 is switched on and off is controlled by resistor R19 and capacitor C7. The duty cycle is determined by a feedback loop which includes transistors Q3 and Q4.

Neglecting for the moment the operation of a plurality of flicker signal generators 110 which are included in the circuit, and which will be described, the duty cycle normally adjusts itself so that the average voltage across the lamp 12 is approximately 1.5 volts. The trim potentiometer VR1 is manually adjusted to establish that voltage. The lamp and circuit characteristics are such that the true RMS energy fed into the lamp is not constant as the battery discharges from 4.5 volts to 2 volts. To reduce variations in brightness versus battery voltage, the resistor R16 applies a small error-reducing current into the duty cycle circuit.

To further reduce operating current, the current controlling the switching transistor Q1 is made independent of battery voltage. This is achieved by the addition of transistor Q2 and resistors R14 and R15.

Flicker is introduced into the lamp 12 by modifying the duty cycle on a pseudo-random basis at a low frequency rate which is visible to the eye. Five independent oscillators are included in the plurality designated 110, and each operates at a slightly different frequency. Each oscillator includes an operational amplifier which is 1/6 of an integrated circuit U1 of the type designated 74HC14. A 22 microfarad capacitor C1 is connected across the battery leads 100 and 102. Battery lead 100 is connected to an operational amplifier which also constitutes 1/6 of the integrated circuit 74HC14, which, in turn, is connected to a series of 1 microfarad capacitors C2, C3, C4, C5 and C6.

Capacitor C2 is connected to input terminal 3 of operational amplifier U1, whose output terminal 4 is connected to 680 ohm resistor R6. Capacitor C3 is connected to input terminal 5 of operational amplifier U1, whose output terminal 6 is connected to a 910 kilo ohm resistor R7. Capacitor C4 is connected to input terminal 9 of operational amplifier U1, whose output terminal 8 is connected to an 820 kilo ohm resistor R8. Capacitor C5 is connected to input terminal 11 of operational amplifier U1, whose output terminal 10 is connected a 750 kilo ohm resistor R9.

Capacitor C6 is connected to input terminal 13 of operational amplifier U1, whose output terminal 12 is connected to a 1 meg a hyphen (-) ohm resistor R10. Resistors R6, R7, R8, R9 and R10 constitute summing resistors, and all are connected to the junction of resistors R20 and R21. Resistors R20 and R21 are limiting resistors which serve to limit the influence of the flicking signal generators 110 on the lamp 12.

Output terminal 4 is connected back to input terminal 3 of operational amplifier U1 through an 820 kilo ohm resistor R1. Output terminal 6 is connected back to terminal 5 through a 910 kilo ohm resistor R2. Output terminal 8 is connected back to input terminal 9 through a 1 meg ohm resistor R3. Output terminal 10 is connected back to input terminal 11 through a 1.1 meg resistor R4. Output terminal 12 is connected back to input terminal 13 through a 1.3 meg resistor R5.

The circuits described above constitute five independent oscillators, each operating at a slightly different frequency. The output signals from the five oscillators are summed with each given a slightly different weighting factor through resistors R6–R10. The resulting signal is injected into the feedback loop of the transistors Q3 and Q4, and it serves to modify the average voltage of the lamp. This results in a flicker which is discernable by the eye of an observer. The circuit will operate from 4.5 volts to just below 2 volts, at which point the flicker signal generator will cease operating. The circuits should be adjusted by the trim potentiometer VR1 so that the duty cycle across the lamp 12 with 3 volts at the input is 50%. Adjusting for a higher duty cycle will increase lamp brightness, but will shorten lamp life significantly and battery life slightly. Adjusting for a lower duty cycle will extend lamp life significantly, and battery life slightly.

The invention provides, therefore, an improved self-contained table lamp which may be used to simulate a candle holder, and which provides a flickering light. The lamp of the invention has a feature in that it exhibits extremely long battery life, and in that it is readily portable and easy to operate and to maintain.

It will be appreciated that while particular embodiments of the invention have been shown and described, modifications may be made. It is intended in the claims to cover all modifications which come within the true spirit and scope of the invention.

We claim:

1. An electric lamp for simulating a candle comprising: a housing; an electric circuit mounted in said housing and including an electric light bulb, a battery mounted in said housing and connected to said electric circuit for supplying energizing power to said electric circuit, said electric circuit including: switching means for intermittingly applying said energizing power to said light bulb with a selected duty cycle to establish an average voltage across said light bulb at a level substantially less than the voltage of said battery; a feed back loop connected to said switching means for establishing the duty cycle of said energizing power intermittingly applied to said light bulb; and signal generating means connected to said feed back loop for introducing a flicker signal to said feed back loop to modify said duty cycle and the average voltage of said energizing power intermittingly applied to said light bulb on a pseudo-random basis to introduce a flicker into the light output of said light bulb; said signal generating means generating said flicker signal at a frequency sufficiently low to render the flicker in the light output of said light bulb visible to the human eye, and said generating means comprising a plurality of independent oscillators each operating at a slightly different frequency and an output network for summing the output signals from said oscillators.

2. The lamp defined in claim 1, in which said electric circuit is mounted on a printed circuit board contained within said housing.

3. The lamp defined in claim 1, and which includes a battery pack contained in said housing, and connector means connecting said battery pack to said electric circuit.

4. The lamp defined in claim 3, in which said housing includes a removable cover to permit replacement of said battery pack.

5. The lamp defined in claim 3, in which said connector means comprises a first piece connected to said battery and second piece connected to said electric circuit, said first and second pieces being detachably attached to one another.

6. The lamp defined in claim 1, in which said electric circuit includes a manually operable power switch operable from the exterior of said housing.

7. The lamp defined in claim 1, and which includes a transparent lens mounted on the top of the housing to surround said light bulb.

8. The combination defined in claim 1, and which includes a holder for receiving the lamp, and a transparent globe mounted on said holder and surrounding said lamp.

9. The combination defined in claim 1, and which includes a free standing base of a selected configuration mounted on the bottom of said housing.

10. The lamp defined in claim 1 in which said output circuit comprises a plurality of resistors connected to respective ones of said oscillators to cause the output signals from said oscillators to be summed to form said flicker signal.

11. The electric lamp defined in claim 10, in which each of said resistors of said plurality has a different value to cause said output signals to be summed each with a slightly differently weighting factor.

12. The lamp defined in claim 1, in which said electric circuit includes circuit means for establishing said duty cycle at the order of fifty (50%) percent.

13. The lamp defined in claim 11 in which said last named circuit means includes a manually operable potentiometer.

* * * * *